US006632048B2

(12) United States Patent
Greenberg

(10) Patent No.: US 6,632,048 B2
(45) Date of Patent: Oct. 14, 2003

(54) MASONRY RETAINER WALL SYSTEM AND METHOD

(75) Inventor: Harold H. Greenberg, Prescott, AZ (US)

(73) Assignee: Pyramid Retaining Walls, LLC, Prescott, AZ (US)

( * ) Notice: Subject to any disclaimer, the term of this patent is extended or adjusted under 35 U.S.C. 154(b) by 25 days.

(21) Appl. No.: 10/005,527

(22) Filed: Dec. 3, 2001

(65) Prior Publication Data

US 2002/0041796 A1 Apr. 11, 2002

Related U.S. Application Data

(63) Continuation-in-part of application No. 09/752,166, filed on Dec. 29, 2000, now Pat. No. 6,431,797, which is a continuation-in-part of application No. 09/332,084, filed on Jun. 14, 1999, now abandoned.

(51) Int. Cl.[7] ..... E02D 5/30

(52) U.S. Cl. ..... 405/284; 405/262; 52/293.2; 52/295

(58) Field of Search ..... 405/284, 286, 405/262; 256/19; 52/295, 587.1, 565, 568, 169.9, 294, 293.2, 293.3

(56) References Cited

U.S. PATENT DOCUMENTS

| | | | | |
|---|---|---|---|---|
| 957,048 | A | 5/1910 | Francis | |
| 1,704,255 | A | 3/1929 | Lewis | |
| 2,815,656 | A | 12/1957 | Klein et al. | 72/16 |
| 3,537,220 | A | 11/1970 | Ellis | 52/225 |
| 4,064,668 | A | 12/1977 | Carter | 52/295 |
| 4,353,194 | A | 10/1982 | Norton | 52/742 |
| 4,452,028 | A | 6/1984 | Norton et al. | 52/744 |
| 4,694,621 | A | 9/1987 | Locke | 52/79.13 |
| 4,706,428 | A | 11/1987 | McCoy et al. | 52/293 |
| 4,726,567 | A | 2/1988 | Greenberg | 256/19 |
| 4,750,306 | A | 6/1988 | Granieri | 52/251 |
| 4,821,483 | A | 4/1989 | Adams | 52/747 |
| 4,982,550 | A | 1/1991 | Vidal et al. | 52/747 |
| 5,007,218 | A | 4/1991 | Bengtson et al. | 52/204 |
| 5,144,779 | A | 9/1992 | Vidal et al. | 52/295 |
| 5,524,405 | A | 6/1996 | Byrd | 52/295 |
| 5,560,172 | A | * 10/1996 | Brophy et al. | 405/286 |
| 5,564,865 | A | 10/1996 | Jansson | 405/286 |
| 5,782,048 | A | 7/1998 | Ramirez | 52/295 |
| 5,794,921 | A | 8/1998 | Greenberg | 256/19 |
| 5,890,332 | A | 4/1999 | Skidmore et al. | 52/271 |
| 6,061,986 | A | 5/2000 | Canada | 52/561 |

* cited by examiner

*Primary Examiner*—Robert E. Pezzuto
*Assistant Examiner*—Alexandra K. Pechhold
(74) *Attorney, Agent, or Firm*—Cahill, Von Hellens & Glazer P.L.C.

(57) ABSTRACT

A retaining wall, supported by a footer, foundation or conventional retaining wall, includes a plurality of post-tensioning rods anchored in the underlying support and extending through the cells of blocks forming the courses of the retaining wall. An elongated apertured plate or a plurality of individual plates rest upon the next to last course to penetrably receive the threaded ends of each of the rods. Nuts engage the threaded ends of the rods to draw the rods to the plate and place them in tension. The top course rests upon the plate or plates and may be constructed as a bond beam. The rods extending from the support may be located adjacent the said side of the retaining wall and bent away therefrom to penetrate the plate or plates at the lateral midpoint of the plate or plates and thereafter extend essentially vertically upwardly. To add an extended wall supported on the bond beam, couplings may be threadedly engaged with the rod ends. Further rods threadedly engage the couplings and extend upwardly. The courses of the extended wall are penetrably engaged with the further rods. An apertured plate or plates rest upon a course to receive the upper threaded ends of the further rods. Nuts engaging the upper ends of the further rods draw the further rods toward the plate or plates to place the further rods in tension. Additional courses or cap blocks may be placed upon the course supporting the plate or plates in the extended wall.

19 Claims, 6 Drawing Sheets

MASONRY RETAINER WALL SYSTEM AND METHOD

This application is a continuation-in-part of application Ser. No. 09/752,166 filed Dec. 29, 2000 and now U.S. Pat. No. 6,431,797, entitled "Masonry Retainer Wall System and Method", which is a continuation-in-part of application Ser. No. 09/332,084 filed Jun. 14, 1999, now abandoned entitled "Masonry Retainer Wall System and Method", all of which describe inventions made by the present inventor.

FIELD OF THE INVENTION

The present invention relates to a masonry wall system and, more particularly to a retaining wall having post tensioning elements and an optional extended wall.

DESCRIPTION OF THE PRIOR ART

The utilization of masonry fences as retaining walls is well known in the prior art. The significant pressures caused by the soil bearing upon the wall surface requires prior art masonry walls to incorporate a significant amount of steel in the form of re-enforcing bars extending through the voids in the masonry block into a footer. A variety of techniques have been used in the prior art in an attempt to strengthen the wall and to provide sufficient resistance to the pressure caused by soil pressing against one side of the wall; these techniques are usually complicated and always expensive. Some prior art techniques have incorporated post-tensioning wherein courses of block have been compressed with respect to each other and the compressed courses are then secured in some manner to a foundation. These latter techniques usually require expensive installation provisions for appropriately supporting the compressed courses on the designated footer.

SUMMARY OF THE INVENTION

The present invention incorporates a masonry retaining wall structure that utilizes a footer, foundation or conventional retaining wall for supporting a retaining wall's first course of masonry block. Post-tensioning rods are imbedded in the footer concrete. The post-tensioning rods extend upwardly essentially vertically from the footer. A plurality of courses of masonry block are then placed on the footer with the respective post-tensioning rods extending through the cells therein. The post-tensioning rods extend upwardly beyond the next to the top course of the masonry block. An elongated clamping plate extends across the cells of the masonry blocks in the next to the top course of blocks. The plate has a plurality of openings therein to permit the passage of the ends of a respective post-tensioning rods. The end of each of the post-tensioning rods is threaded to accept a nut which is placed on the rod and threaded to engage the clamping plate. Predetermined tension is placed on the respective post-tensioning rods. A top course of masonry blocks may be placed on the plate with the cells therein receiving the threaded rod ends engaging the nuts and being filled with grout. Horizontally aligned rebar(s) may be placed in the top course to tie in the masonry blocks with one another and form a bond beam having its top surface in general alignment with the grade of the said being retained. To build thereon an extended wall, a threaded coupling is attached to one or more of the threaded rod ends. The threaded ends of further post-tensioning rods are threadedly engaged with respective couplings to extend upwardly through the top course subsequently formed as a bond beam and into the extended wall supported upon the retaining wall. The upper ends of these further post-tensioning rods are secured to a plate resting on a course and a nut draws these rods toward such plate to place them in tension.

OBJECTS OF THE INVENTION

A primary object of the present invention is to provide a masonry retaining wall system that may be constructed relatively inexpensively and nevertheless provides sufficient strength to resist the forces of the soil pressing against one side thereof.

Another object of the present invention is to provide a retaining wall system wherein a very high strength wall retains the soil and provides a base upon which a less expensive upwardly extended wall may be supported.

Still another object of the present invention is to provide a retaining wall system that can be inexpensively constructed to provide all of the advantages of a conventional retaining wall system and to provide an economical retaining wall for supporting a fence extending beyond the grade level of the soil being retained by the retaining wall.

Yet another object of the present invention to provide a retaining wall system incorporating post-tensioning to compress the courses of block within the retaining wall against a footer, a foundation or a conventionally constructed retaining wall and provide a significant cost reduction in the construction of the complete retaining wall.

A further object of the present invention is to provide for post-tensioning of an upwardly extended wall supported upon a retaining wall incorporating post-tensioning to exert compression forces between the upwardly extending wall and the retaining wall.

A still further object of the present invention is to provide post-tensioning intermediate a footer (or foundation or conventional retaining wall) an intermediate retaining wall and an extended wall extending upwardly from the intermediate retaining wall.

A yet further object of the present invention is to provide a method for post-tensioning a retaining wall.

A yet further object of the present invention is to provide a method for post-tensioning an extended wall supported by an intermediate retaining wall with a conventional footer, foundation or retaining wall.

The objects will become apparent to those skilled in the art as the description of the invention proceeds.

BRIEF DESCRIPTION OF THE DRAWINGS

The present invention will be described with greater specificity and clarity with reference to the following figures, in which.

DESCRIPTION OF THE PREFERRED EMBODIMENTS

Figure 1:
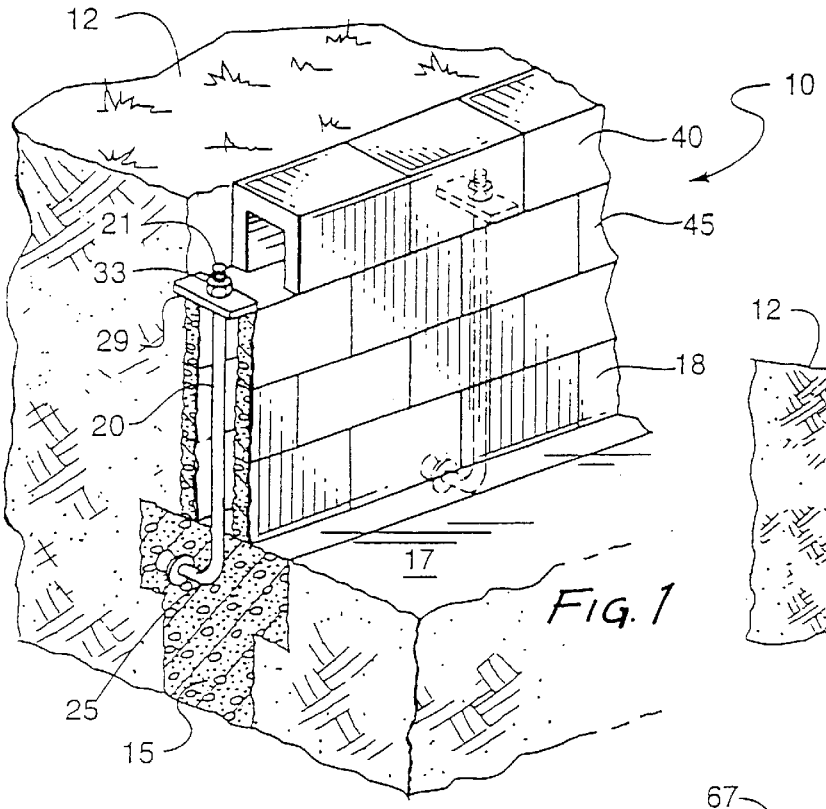
FIG. 1 is a perspective view of a retaining wall system.
Figure 2:
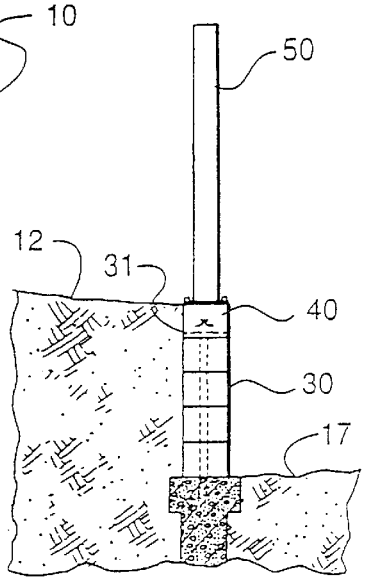
FIG. 2 is a sectional view of a retaining wall and showing an upwardly extending masonry fence extending above the upper grade of the retaining wall system.
Figure 3:
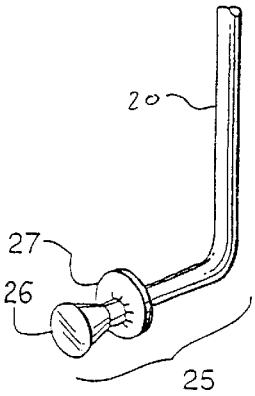
FIG. 3 is a perspective view of the end of a post-tensioning rod showing the upset end of the rod and a flange member positioned at the end of the rod before the rod is imbedded in the concrete.

FIGS. 1, 2, 3 and 3*a*, illustrate a retaining wall system having a masonry block retaining wall 10 for retaining soil extending below an upper or surface grade level 12 behind the retaining wall. A footer 15 is poured below a lower grade level 17 of the soil, which footer provides the support for the retaining wall. Lower course 18 of the retaining wall is placed on footer 15 and post-tensioning rods 20 are imbedded in the footer concrete while the latter is plastic. The post-tensioning rods are spaced at predetermined horizontal intervals to register with the voids or cells in the masonry block and extend vertically upwardly terminating in respective threaded ends 21.

Lower portion 25 of each of the post-tensioning rods is placed at a right angle as shown and is also provided with an upset end 26 that may be formed by peening either at a factory or at the job site. Each of the post-tensioning rods 25 is provided with a flange member 27 adjacent the end of the rod that may take the form of a large washer, as shown, and may also be secured to the rod, such as by welding. The combination of the peening or upsetting of end 26 of the post-tensioning rod and flange member 27 provide an extremely high "pull out" strength. Alternatively, the end of rod 20 may have a threaded end 23 and a threadedly engaged nut 24. When the tension on a straight post-tension rod is very high, it is entirely possible to literally pull the rod out from the footer even though the footer concrete is set. Upset end 26 and flange member 27 or nut 24 provided on each imbedded end of post-tensioning rods 20 provide an appropriate anchoring system to prevent the post-tensioning rod from being withdrawn even if substantial tension is applied thereto. It is also possible to use other than a right angle or 90 degree bend in the embedded portion of the post-tensioning rods. In some circumstances, the flange member may be mounted at the end of a straight rod with or without an increase in diameter to provide sufficient "pull out" strength to eliminate the necessity of providing a bend in the rod.

Post-tensioning rods 20 extend upwardly through voids or cells in successive courses of masonry block and terminate in threaded ends 21. It may be noted that the successive courses of block in the retaining wall are arranged in overlapping or staggered configuration with respect to preceding courses of block. To facilitate the transfer of compressive forces exerted on the retaining wall by the post-tensioning rods, the blocks of successive courses are staggered so that they overlap with courses immediately therebelow to transfer the compressive force from one course to the other. The spacing between adjacent vertically extending post-tensioning rods will depend on the strength necessary for the retaining wall to retain the soil pushing against one side thereof. Further, it may be possible to increase the lateral width of the individual masonry blocks to resist tipping or bending forces applied to the wall.

Each of the vertically extending post-tensioning rods extends through a corresponding hole in a clamping plate 29 that bridges the gap between the opposing walls 30 and 31 of the respective masonry block in the top course of the retaining wall. The hole provided in the respective clamping plates permits the individual post-tensioning rods to extend therethrough and to accept a tightening nut 33 thereon. The respective nuts are then tightened to a predetermined post-tensioning rod tensile value to provide substantial compressive force to create a retaining wall of substantial strength at substantially less cost than a retaining wall of identical strength but constructed in accordance with prior art techniques.

A course of cap blocks 40 may be placed over the upper most course of the retaining wall to protect the exposed ends of the post-tensioning rods as well as the plates and nuts. Soil is then placed against the chosen side of the retaining wall up to the retained soil grade level 12.

The upper most course 45 of the retaining wall (excluding the top course of cap blocks) can also form the basis for an extension wall 50 that extends above the upper grade level of the soil retained by the retaining wall. Extension wall 50 may be formed using conventional techniques such as by extending reinforcing bar through the voids in the retaining wall into the footer and filling those voids in the retaining wall and the extension wall with mortar; alternatively, the extension wall can be supported using post-tensioning techniques in accordance with the teachings set forth in U.S. Pat. No. 4,726,567. Further, a variety of prior art masonry wall techniques may be used for the extension wall including the use of interlocking or tongue and groove-type masonry blocks. It is also possible to construct the extension wall using masonry pillars with conventional wooden or iron slats extending between the respective pillars.

The method shown in FIGS. 1–4 incorporates the formation of a footer below a first grade with the upper surface of the footer at or slightly below that grade. A plurality of post-tensioning rods are positioned in the footer while the footer is still in a plastic condition, and extending each of the post-tensioning rods vertically. A plurality of courses of masonry block are then placed on the footer with the respective post-tensioning rods extending through voids or cells in the individual blocks. When the final course of the retaining wall is completed, a plurality of clamping plates are placed over the ends of the post-tensioning rods with the rods extending through holes provided in the respective plates and are positioned to bridge the void or cell in the respective masonry block extending from the front to the rear surface thereof. A nut is threaded on the threaded end of the post-tensioning rod and the rod is tensioned to provide a predetermined force on the retaining wall. A cap course is placed on the upper most course of the retaining wall to provide a means for protecting and covering the exposed ends of the vertically extending tensioning rods and plates. The cap course may be applied in a conventional manner with mortar using prior art techniques. Soil is then placed behind the retaining wall up to the desired upper level grade of the system.

An extension wall, or fence, may be constructed by extending selected vertically extending tension rods upwardly through voids or cells in the masonry block forming the extension wall. Clamping plates and nuts are positioned over the threaded ends of the post-tensioning rod and the rod tensioned to a predetermined value. It is important to note that only selected ones of the vertically extending post-tensioning rods are used to provide the necessary tensioning force for the extension wall since the latter is not called upon to withstand the forces exerted by soil abutting a surface of the retaining wall. Thus, depending on the necessary strength of the retaining wall, every third or every fourth post-tensioning rod in the retaining wall may extend upwardly into the voids of the masonry block forming the extension wall. In another embodiment, the method includes the formation of an extension wall using rebar extending through the voids of the retaining wall upwardly through the voids of the extension wall and anchoring the rebar in a conventional manner in the footer as well as locking the rebar to the extension wall using known prior art techniques such as grouting.

Figure 4:
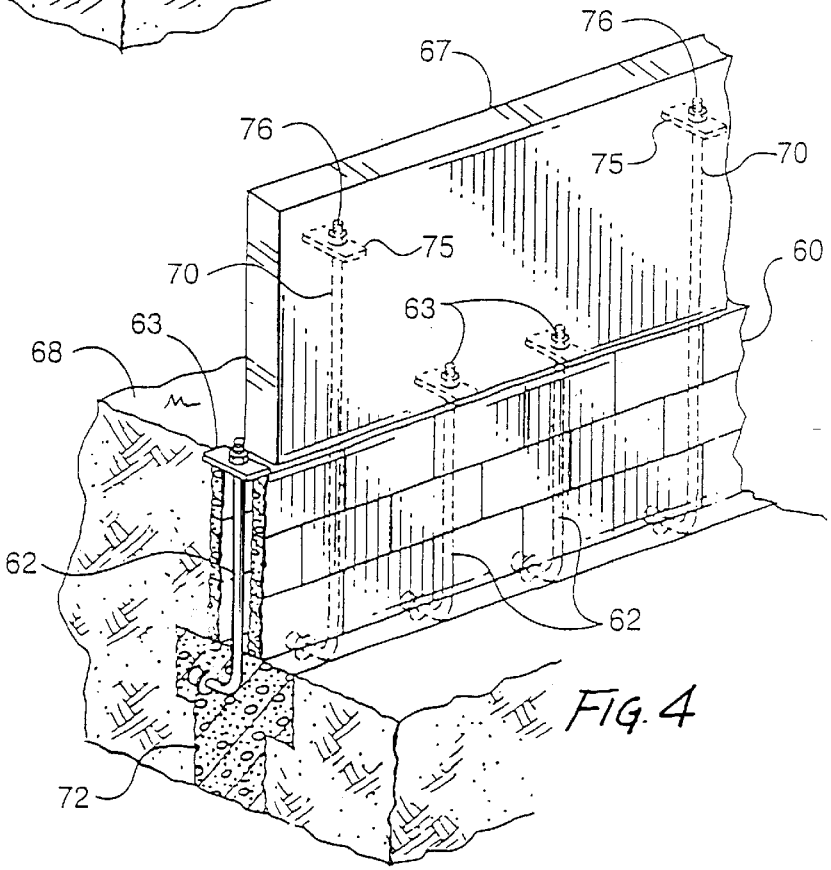
FIG. 4 is a perspective view of a portion of a retaining wall system and including an extension wall formed as part of the wall system.
Figure 3A:
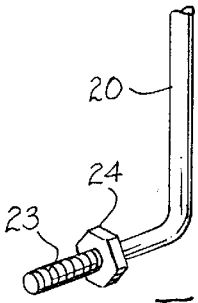
FIG. 3*a* is a perspective view of an end of a post-tensioning rod showing a threaded end engaged by a nut and illustrates a variant of the rod end shown in FIG. 3.

Referring to FIG. 4, a retaining wall system incorporating an extension wall is shown. Retaining wall 60 is formed in a manner previously described including the utilization of a plurality of post-tensioning rods 62, each of which extends vertically and is provided with a respective clamping plate 63 and a nut on the threaded end of the rod to provide the required tension. An extension wall 67 is then constructed beginning at second grade level 68 and extending upwardly to a desired height. Extension wall 67 may be formed of masonry block having less width than the retaining wall since less strength is required. In the embodiment chosen for illustration in FIG. 4, selected post-tensioning rods 70 extend upwardly from footer 72 through voids in the masonry block forming retaining wall 60 and through voids in the masonry block forming extension wall 67. In a manner similar to that described previously, these selected vertically extending post-tensioning rods are provided with plates 75 and corresponding nuts 76 that are used to provide the appropriate post-tensioning tension within the respective post-tensioning rods. It may be noted that only selected post-tensioning rods extend upwardly into the extension wall. The necessary strength of the retaining wall 60 requires a predetermined number of vertically extending post-tensioning rods to provide the necessary strength for the retaining wall to resist the forces exerted by the soil extending upwardly to second grade level 68. Extension wall 67 is not required to withstand the force of any soil abutting against a surface thereof; therefore, only selected ones of the post-tensioning rods need to be extended through the voids in the extension wall.

Alternatively, vertically extending post-tensioning rods 70 may be selected to be different than those rods used for post-tensioning of the retaining wall. That is, the post-tensioning rods for extension wall 67 can be anchored through the use of anchoring plates positioned between courses within retaining wall 60 and extending upwardly to a clamping plate positioned at the top of the extension wall. Thus, the latter configuration would have a plurality of vertically extending post-tensioning rods extending from the footer upwardly to plates positioned at the top course of the retaining wall; however, substantially fewer post-tensioning rods would be anchored in the top course of the retaining wall and extend upwardly to the top course of the extension wall. In this manner, the extension wall is provided with the requisite strength which, however, is significantly lower than the strength required of the retaining wall. The utilization of the selected extended post-tensioning rods to secure the extension wall above the retaining wall avoids the necessity of securing rods separately for the extension wall extending downwardly into the foundation. It also avoids the expensive alternative of creating a bond beam in the top courses of the retaining wall to provide a means for attaching the tension rods for the fence on top of the retaining wall below. The masonry blocks used in the retaining wall could be interlocking with a mortarless head joint. The mortar on the bed joints could be left off as well under certain circumstances. One of the purposes of the bed joint mortar is leveling of the courses; if leveling is not required, or if the block dimensions are so precise that they are self leveling or if some other leveling method is used, then bed joint mortar may be left off. Bed joint or head joint mortar is not required for strength since that is supplied by the post-tensioning.

Figure 5:
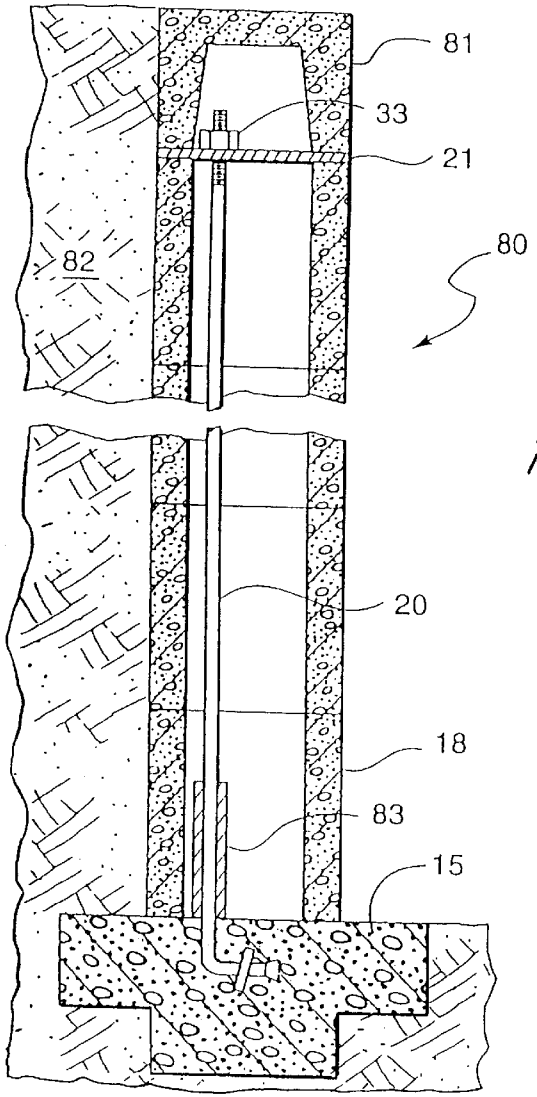
FIG. 5 is a foreshortened vertical sectional view of a soil retaining wall.

FIG. 5 illustrates another modification of the soil retaining system. This system, indicated generally by reference numeral 80 comprises a footer 15. Lower course 18 of the retaining wall is placed on the footer while the lower ends of post-tensioning rods 20 are embedded in footer 15 when the latter is plastic. Unlike the previously described embodiments, however, rods 20 are not centered in blocks 18 but are offset to be closer to the side of the wall contacted by soil 82. With this configuration, when nuts 33 are tightened on their respective clamping plates 29 the compressive forces are transmitted more directly to the side of the wall contacted by soil 82 and which side must resist the persistent static loads and intermittent lateral loads on the wall. The intermittent loads may be caused by heavy vehicles running over the soil nearby.

A significant advantage of the hollow block post tensioned structure is that it offers very little opportunity for ground water seeping into the structure to exit the opposite side and produce efflorescence. Consequently little if any waterproofing need be applied to the soil side of the structure, thereby reducing the cost of construction. It is, however, likely that some moisture may enter the interior of the structure and puddle in the interior of lower course of blocks 18. To preclude this moisture from having a deleterious effect on post-tensioning rods 20, a lower region of the rods immediately above footer 15 is preferably coated, or wrapped, or embedded in a waterproof covering 83.

Figure 6:
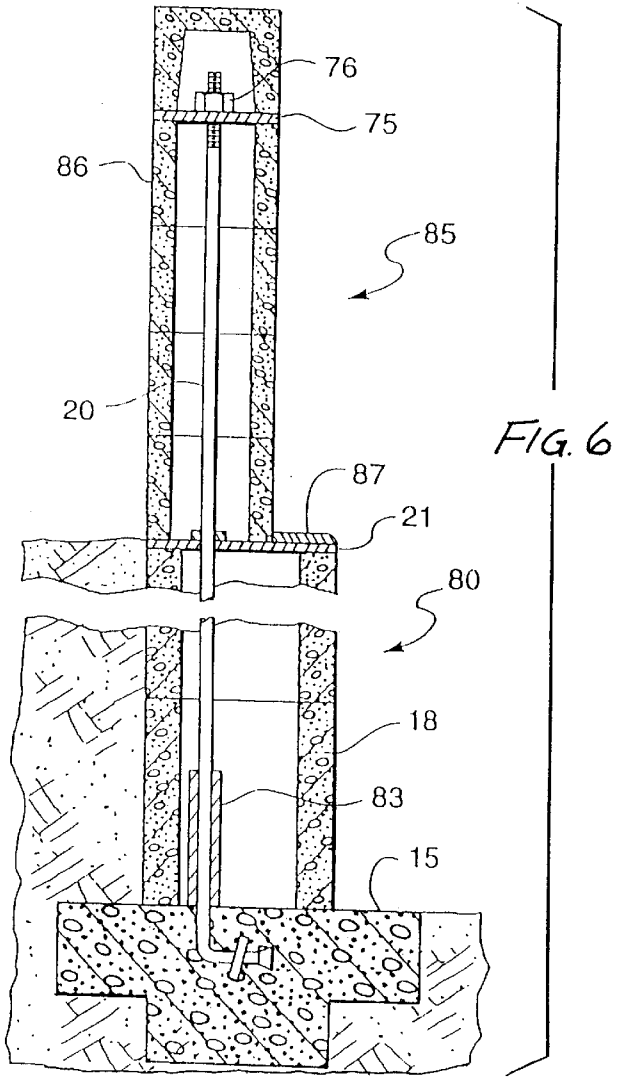
FIG. 6 is a foreshortened vertical sectional view of a soil retaining wall having a masonry fence erected thereon.

FIG. 6 illustrates the manner in which an extension fence, or wall, 85 can be mounted on top of system 80 shown in FIG. 5. Because fence 85 can be subjected to intermittent lateral loads, or forces, from either side it is desirable that post-tensional rods 20 extend up through the central regions of the courses of fence blocks 86. To achieve this result, fence blocks 86 are preferably of less width than the blocks in system 80 therebeneath. Thus, when nuts 76 are tightened on plates 75, the fence structure is compressed evenly to resist loads from either side.

The one disadvantage of employing narrower blocks 86 in fence 85 is that this leaves exposed to the elements of weather portions of plates 21 in the structure below. To remedy this condition the exposed regions of plates 21 are provided with a weather-proof coating or covering 87.

Figure 7:
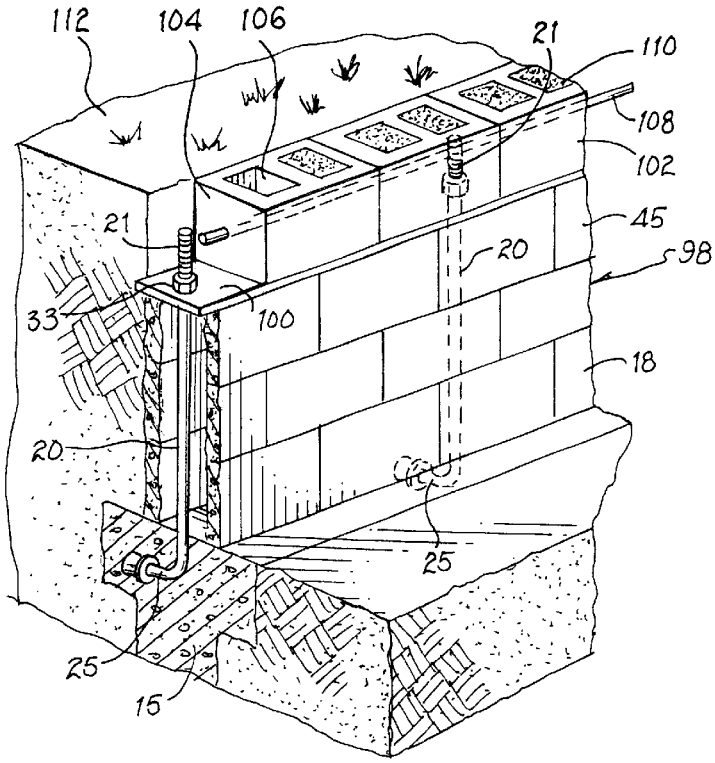
FIG. 7 illustrates a variant of the retaining wall shown in FIG. 1.

Referring to FIG. 7, there is illustrated a post-tensioning wall similar to that shown in FIG. 1 except for the differences set forth below. An elongated plate 100 rests upon course 45 to cover the voids or cells in the blocks of this course. A plurality of apertures are disposed in the plate to permit penetrable engagement by threaded ends 21 of each of rods 20 extending upwardly from footer 15. By tightening each of nuts 33 a predetermined amount, each of rods 20 will be under tension to compress the retaining wall. It is to be understood that instead of an elongated plate 100 for penetrably engaging the upper ends of rods 20, a plurality of apertured plates may be used with each plate penetrably receiving the upper end(s) of one or more of the rods; for instance, such as plates 29 shown in FIG. 1. Accordingly, when plate 100 is hereafter discussed, this term is to be construed as defining an elongated plate or a plurality of plates for penetrably receiving corresponding rods. A top course 102 is mounted on plate 100. Blocks 104 of this course are positioned to receive threaded ends 21 of rods 20 within corresponding ones of cells 106. One or more rebars 108 may extend through notches in blocks 104 (which may be knock out blocks) of course 102 to structurally and functionally mate the blocks with one another. Grout 110 is deposited in each of cells 106 to mechanically and chemically engage respective ones of rebars 108, plate 100 and each of threaded ends 21 along with respective nuts 33. Thereby, course 102 becomes a bond beam. When a plurality of plates spaced apart from one another are used, bond beam paper or similar shield can be used to prevent grout from dropping through cells 106 of blocks 104. The use of grout has the further advantage of covering nuts 33 to prevent tampering and possible compromise of the effectiveness of the post-tensioning rods. It may be noted that the level of top course 102 is essentially even with grade level 112 of the adjacent soil.

Figure 8:
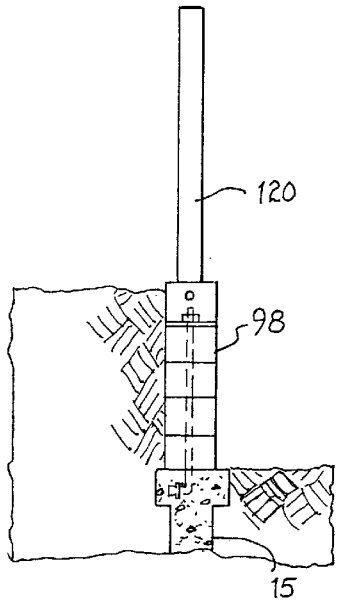
FIG. 8 illustrates the variant shown in FIG. 7 with an extended wall mounted thereupon.

FIG. 8 is a cross-sectional view of retaining wall 98, as shown in FIG. 7. An extended wall 120 may be built upon top course 102 with or without any internal reenforcements. It may be noted that the flat surface of top course 102 provided by grout 110 will permit extended wall 120 to be centered, as shown, or located laterally therefrom close to or in alignment with a corresponding side of retaining wall 98.

Figure 9A:
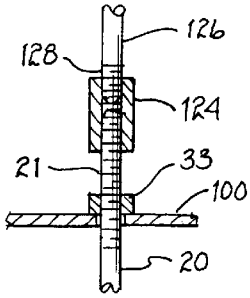
FIG. 9A is a cross-sectional view illustrating a coupling attached to a threaded end of a tensioning rod.
Figure 9:
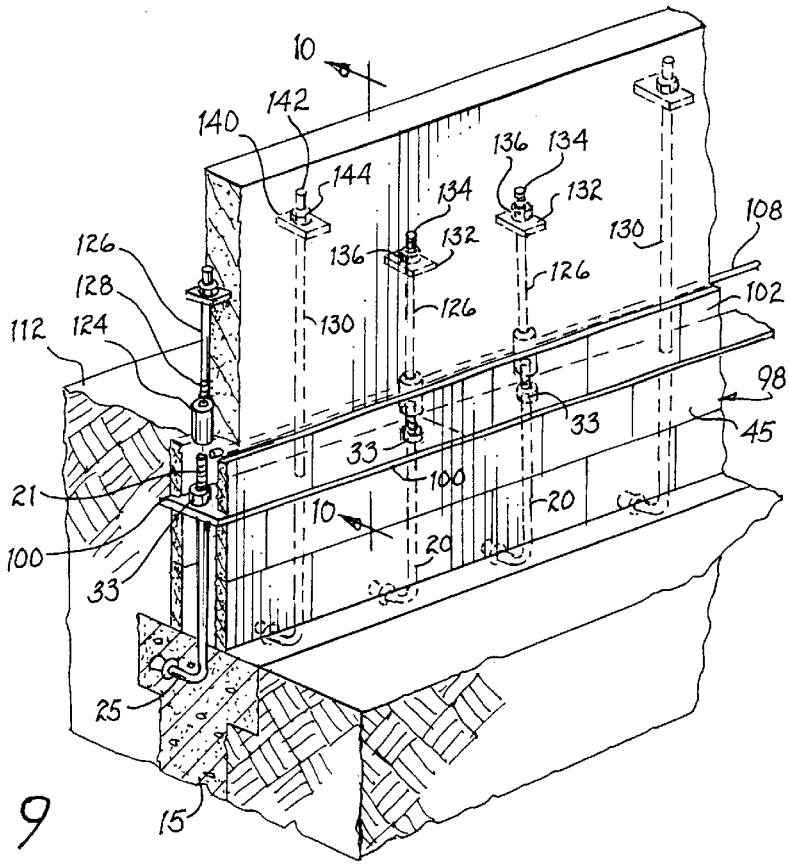
FIG. 9 illustrates tensioning rods extending from the retaining wall into an extended wall.
Figure 10:
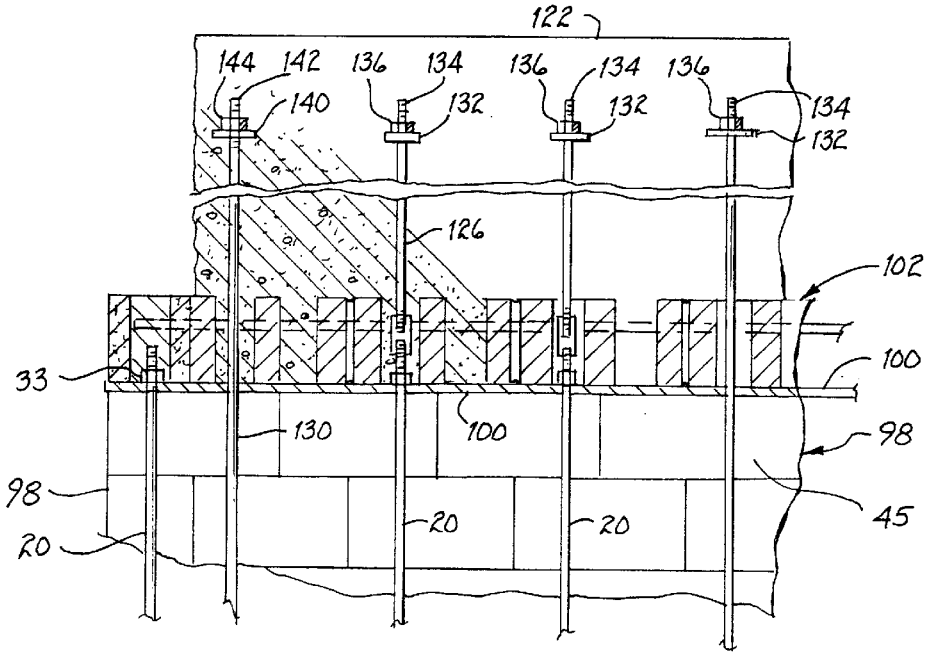
FIG. 10 is a cross-sectional view taken along lines 10—10, as shown in FIG. 9.

FIGS. 9 and 10 illustrate a retaining wall 98 similar to that shown and described with respect to FIG. 7. Accordingly, common reference numerals will be employed. An extended wall 122 extends upwardly from the top surface of course 102. In building the retaining wall and the extended wall, rods 20 are placed in tension by nuts 33 bearing against plate 100. Thereafter, threaded couplings are placed in threaded engagement with threaded ends 21. Each of further rods 126 include a threaded end 128 for threaded engagement with a respective coupling 124, as shown in FIG. 9A. In the alternative, or commensurate with rods 20, as illustrated, extended rods 130 may be anchored in footer 15 and extend upwardly through corresponding apertures in plate 100 into what will become extended wall 122. After rods 126 are in place, grout is poured into the cells in the blocks forming course 102 to encapsulate threaded ends 21, couplings 124 and the extent to which rods 126 extended into course 102. If used, rods 130 disposed within course 102 will also be encircled with grout. Thereafter, extended wall 122 will be built one course at a time. After a predetermined number of courses, apertured plates 132 are placed in penetrable engagement with threaded end 134 of each of rods 126. A nut 136 engages each of threaded ends 134 to draw the respective plate 132 against the top of the corresponding course to place each of rods 126 under tension. If rods 130 are used, an apertured plate 140 is penetrably mounted upon threaded end 142 of each of rods 130. A nut 144 will draw plate 140 against the top of the corresponding course. Thereby, each of rods 130 is placed in tension. From the above description it will become apparent that each of combined rods 20/126 and rods 130 are anchored in footer 15 and will be in tension to compress extended wall 122 against compressed retaining wall 98. As shown in FIG. 10, if retaining wall 122 does not extend for the full length of retaining wall 98, rods 20 would terminate within course 102, like the retaining wall shown in FIG. 7. It is to be noted that plates 132 and/or plates 140 may extend sufficiently to penetrably receive more than one rod; in fact, a single elongated plate (like plate 100) may be positioned between courses of the extended wall to serve the function of either or both of plates 132 and 140.

Figure 11:
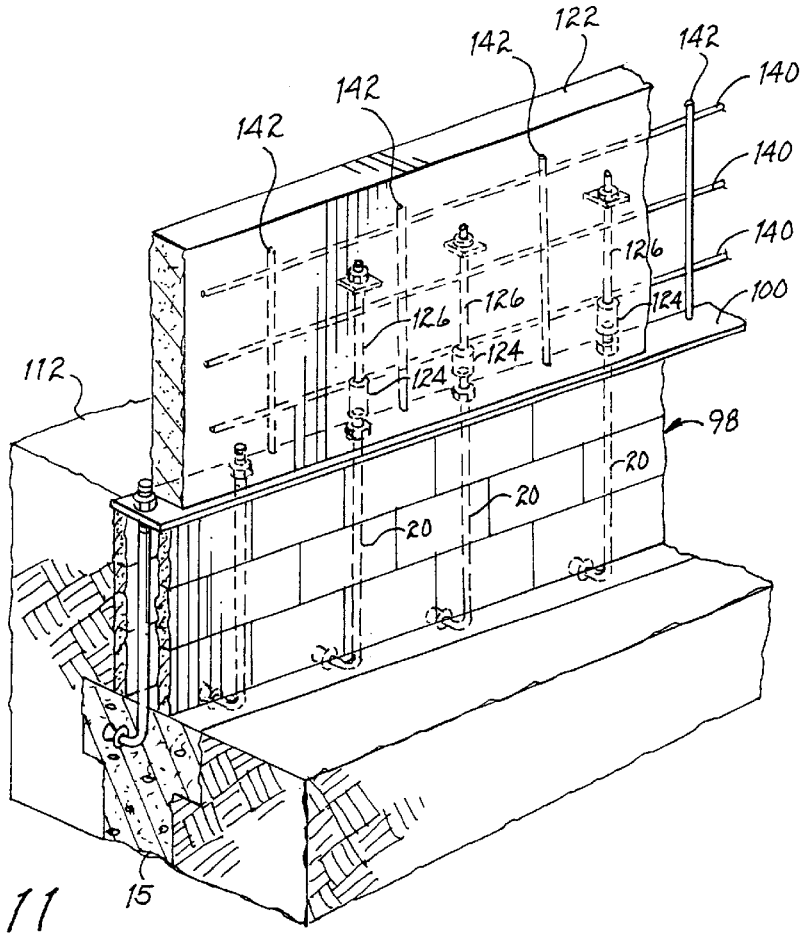
FIG. 11 is a partial view showing a variant of the retaining and extended walls shown in FIGS. 9 and 10.

Referring to FIG. 11, there is shown a retaining wall 98 like that shown in FIGS. 9 and 10. Furthermore, a number of rods 20 are shown, some of which may include a coupling to engage a corresponding rod 126. The main difference between the structure shown in FIG. 11 and that shown in FIGS. 9 and 10 is directed to the use of not only post-tensioning members in the extended wall but rebar reinforcements. That is, one or more horizontal rebars 140 may be built into the courses of extended wall 122. Similarly, one or more vertical rebars 142 may be built into the extended wall. With such reinforcements, in combination with post-tensioning, extended wall 122 will become extremely robust to withstand anticipated forces that may act thereon.

Figure 12:
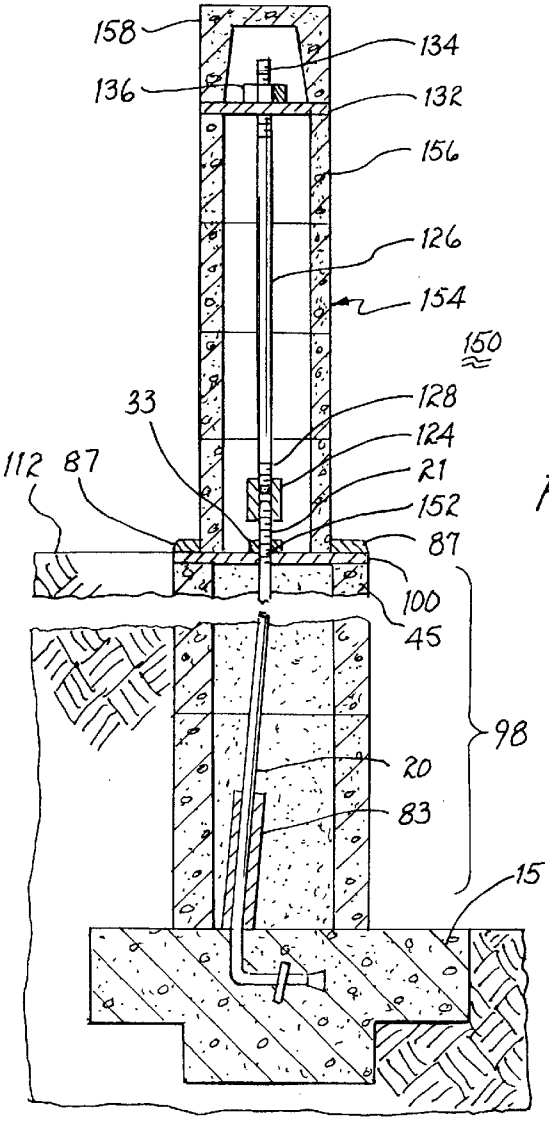
FIG. 12 illustrates a cross-sectional view of a variant of the retaining and extended walls shown in FIG. 9.

FIG. 12 illustrates a variant 150 of the structure shown and described with respect to FIG. 6. Accordingly, common reference numerals will be used. A rod 20 is anchored into footer 15 and extends upwardly from the footer at an angle to place the upper end at the approximate center between the lateral sides of retaining wall 98. Plate 100 rests upon top course 45 and includes an aperture 152 corresponding with each of rods 20 to penetrably receive threaded end 21 of a rod. A nut 33 engages the threaded end and, upon tightening the nut, will place rod 20 in tension. As illustrated, rod 20 may include a covering 83, as described above. An extended wall 154 is built upon and essentially centered along the course upon which plate 100 rests. A further rod 126 is secured to threaded end 21 by engaging its threaded end 128 with a coupling 124 threadedly interconnecting both threaded ends. After or before attachment of rods 126, the parts of rods 20 extending above plate 100 may be bent to essentially a vertical orientation. An apertured plate, such as plate 132 (or a plurality of plates), extends across course 156 to penetrably receive threaded end 134 of rod 126. A nut, such as nut 136, is in threaded engagement with the threaded end and bears against plate 132 to place rod 126 in tension. Accordingly, nut 33 bearing against plate 100 will place retaining wall 98 in compression. Nut 136 bearing against plate 132 will place extended wall 154 in compression. Cap blocks 158 provide a protective cover to plate(s) 132, threaded ends 134 and nuts 136. To protect the exposed upper part of plate 100, a covering or coating 87, as described above, may be located on the plate extending laterally of extended wall 154.

Figure 13:
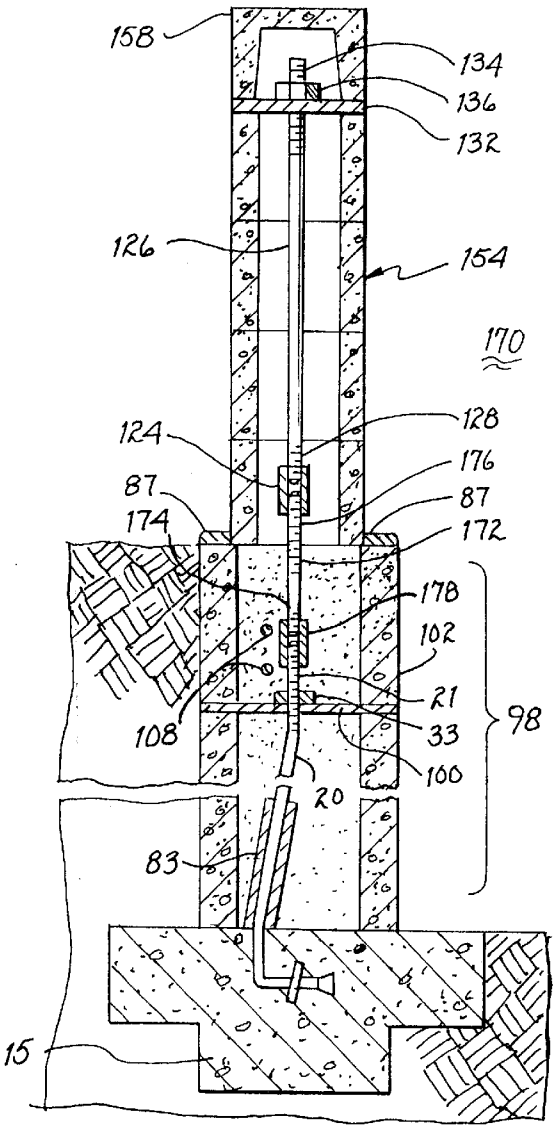
FIG. 13 is a cross-sectional view illustrating a tension rod extending through a retaining wall and into a supported extended wall.

FIG. 13 illustrates a variant 170 similar to variant 150 shown in FIG. 12 except that retaining wall 98 is constructed in accordance with the retaining wall 98 shown in FIGS. 9 and 10. Footer 15 supports a plurality of courses, such as courses 45 shown in FIGS. 9 and 10. The top most one of these courses supports plate 100. A rod 20, bent as shown and described in FIG. 12, includes a threaded end 21 extending through an aperture in plate 100 and is secured to the plate by a nut 33. A rod 172 includes a lower threaded end 174 and an upper threaded end 176. A coupling 178 interconnects threaded end 21 with threaded end 174. Course 102 includes one or more rebars 108 extending therethrough and is filled with grout to form a bond beam. An extended wall 154, similar to that described with respect to FIG. 12, is built upon the top of course 102. As described above, extended wall 154 includes rods 126, plate(s) 132, nuts 136 and threaded ends 134 along with threaded ends 128 and couplings 124. Cap blocks 158 may be used to protect and enclose the upper end of the extended wall.

Figure 14:
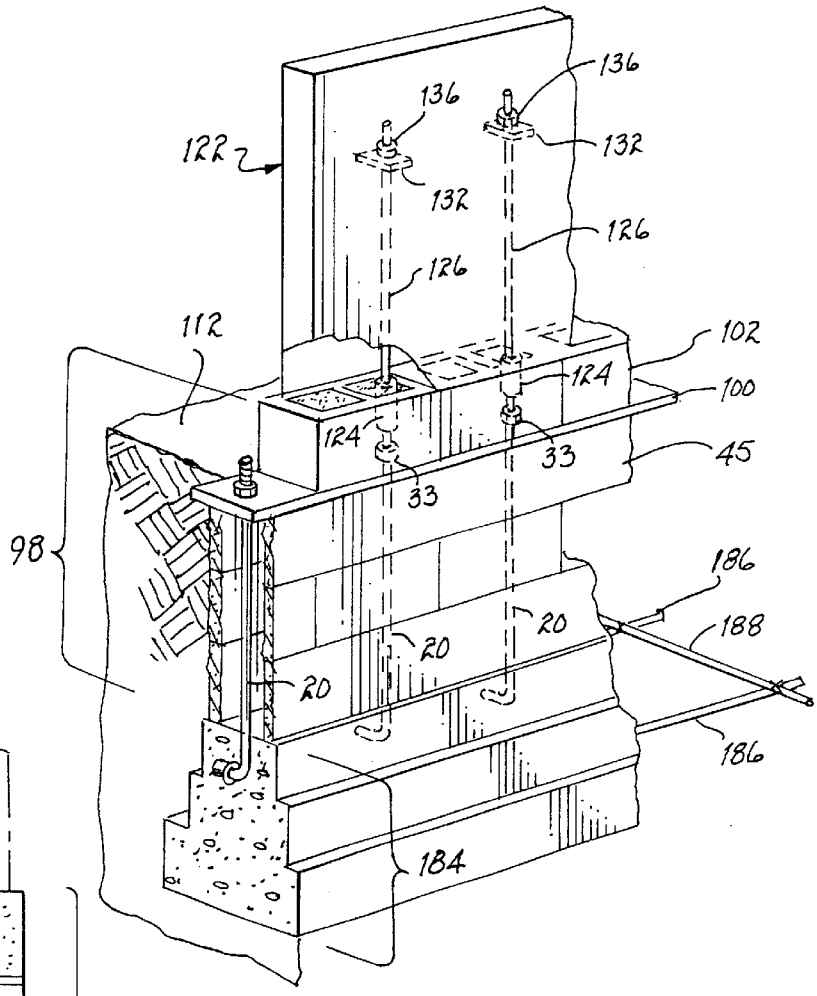
FIG. 14 illustrates a retaining wall and extended wall constructed in accordance with the present invention and supported upon any of conventional footings, foundations or retaining walls.

Referring to FIG. 14, there is illustrated a retaining wall 98, as described above. This retaining wall may support an extended wall, such as wall 122. Support for the retaining wall is provided by a foundation 184 of conventional construction and intended to support significant weight or encompass height generally greater than a conventional footer. To provide the requisite supporting capability, a plurality of longitudinally oriented rebars 186 may be imbedded in the foundation. For further strength, a plurality of laterally oriented rebars 188 may be disposed within the foundation. As noted, a plurality of rods 20 may be anchored in the foundation to provide post-tensioning of the retaining wall. These rods may have attached further rods 126 extending into extended wall 122, as described above. With a foundation of this type, the retaining wall may be of significant height and have sufficient strength to withstand the forces imposed by the soil disposed below grade level 112.

Figure 15:
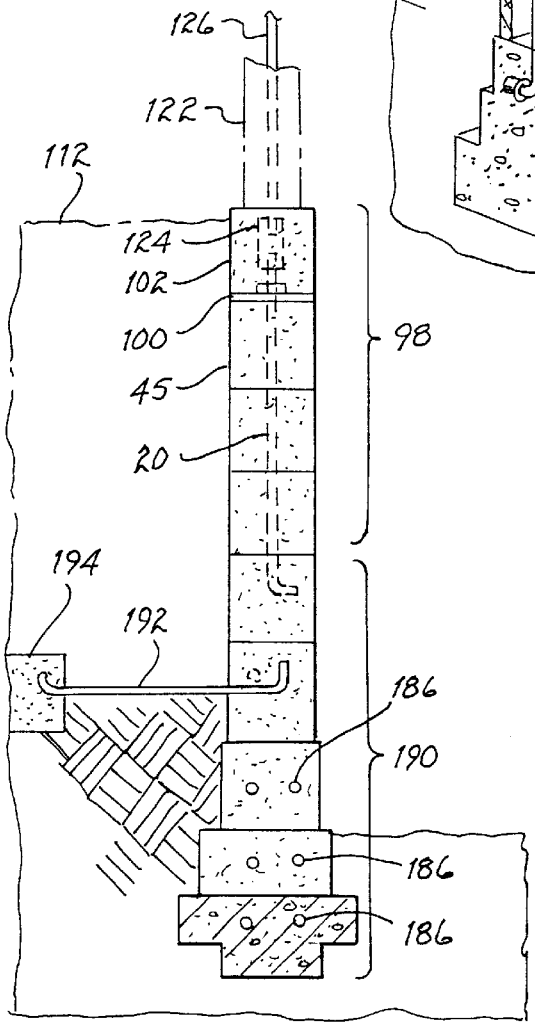
FIG. 15 is a cross-sectional view illustrating the retaining and extended wall embodying the present invention supported upon a conventional retaining wall that may include a footer.

FIG. 15 is similar to the construction illustrated in FIG. 14 except that extended wall 122 and retaining wall 98 may be mounted upon and supported by a conventionally constructed retaining wall 190. Such retaining wall may take any number of configurations, as is well known. One such configuration may include a plurality of rods 192 anchored in retaining wall 190 and extending to and embedded within an anchor 194 buried in the soil below grade level 112. It is to be appreciated that conventional retaining wall 190 may be tapered, whether planar or stepped. A plurality of rebars 186 may be disposed longitudinally within one or more sections of conventional retaining wall 190; these rebars may be interlaced with further rebars extending laterally.

The present invention has been described in terms of selected specific embodiments incorporating details to facilitate the understanding of the principles of construction and operation of the invention. Such reference herein to specific embodiments and details thereof are not intended to limit the scope of the claims appended hereto. It will be apparent to those skilled in the art that modifications may be made without departing from the spirit and scope of the invention.

What is claimed is:

1. A retaining wall for retaining a body of soil, said retaining wall comprising in combination:

a) a footer positioned at or below the lower grade level of the soil;

b) a plurality of vertically extending post-tensioning rods having one end of each of said rods anchored in said footer and threads disposed about the other end;

c) a plurality of courses of masonry blocks having cells therein for penetrably receiving the respective vertically extending post-tensioning rods;

d) at least one claming plate disposed along the top of the course next to the top course, at least some of said plates including at least one aperture, each of said apertures receiving a corresponding one of vertically extending post-tensioning rods to extend therethrough;

e) a plurality of nuts, each of said nuts being threaded on said threaded end of one of said post-tensioning rods to apply force to said clamping plate and to post-tension said rods;

f) a top course of masonry blocks having cells for receiving respective ones of said threaded ends and attached ones of said nuts and including grout disposed within each of the cells to envelope said threaded ends and nuts and to fill said cells, whereby the top surface of the top course is essentially planar; and g) an extended wall extending vertically from said top course.

2. The retaining wall as set forth in claim 1 further including a water-proof covering on the regions of said post-tensioning reds immediately above said footer.

3. The retaining wall as set forth in claim 1 wherein said one end includes a threaded section and a nut threadedly engaging said threaded section.

4. A retaining wall for retaining a body of soil, said retaining wall comprising in combination:

a) a footer positioned at or below the lower grade level of the soil;

b) a plurality of vertically extending post-tensioning rods having one end of each of said rods anchored in said footer and threads disposed about the other end;

c) a plurality of courses of masonry blocks including a top course having cells therein for penetrably receiving the respective vertically extending post-tensioning rods;

d) at least one claming plate disposed along the top of the course next to said top course, at least some of said plates including at least one aperture, each of said apertures receiving a corresponding one of sa d vertically extending post-tensioning rods to extend therethrough;

e) a plurality of nuts each of said nuts being threaded on said threaded end of one of said post-tensioning rods to apply force to said clamping plate and to post-tension said rods;

f) said top course of masonry blocks having cells for receiving respective ones of said threaded ends and attached one of said nuts;

g) an extended wall e tending vertically from said top course;

h) a threaded coupling threadedly engaging said threaded end of selected ones of said post-tensioning rods;

i) a further post tensioning rod in threaded engagement with each of said couplings and having a threaded end extending into said extended wall;

j) a plate resting upon a course of said extended wall for penetrably receiving said threaded end of a respective one of said further post-tensioning rods; and k) a nut for engaging aid threaded end of said further post-tensioning rod to draw said further post-tensioning rod toward said plate and place said further post-tensioning rod in tension.

5. The retaining wall as set forth in claim 4 wherein said extended wall includes:

a) a plurality of courses of masonry fence blocks having cells surrounding said further post-tensioning rods; and b) said fence blocks being narrower than the blocks of said retaining wall and being centered on said further post-tensioning rods.

6. A retaining wall for retaining soil on one side thereof, said retaining wall comprising in combination:

a) a support for said retaining wall;

b) a plurality of courses of blocks having open cells extending vertically therethrough;

c) a plurality of rods having one end anchored in said support and extending upwardly through the cells in the blocks of said courses;

d) at least one apertured plate disposed along the top of one of said plurality of courses for penetrably receiving on or more of said threaded ends of said rods;

e) a plurality of nuts for threadedly engaging said threaded ends of said rods to draw said rods toward said plate an place said rods in tension;

f) a bond beam supported by said plate for encapsulating said threaded ends of said rod and said nuts;

g) a threaded coupling threadedly attached to each of said threaded ends of said rods;

h) a plurality of further rods, each of said further rods having upper and lower threaded ends, said lower threaded e d of each of said further rods being threadedly engaged with one of said couplings;

i) a plurality of further courses laid on said bond beam to penetrably receive said further rods and defining an extended wall;

j) at least one apertured further plate resting upon one of said further courses to receive at least one of said upper end of said further rods; and k) a plurality of further nuts, each of said further nuts being in threaded engagement with one of said upper ends of said further rods to draw said further rod toward said at least one plate and place said further rod in tension within said extended wall.

7. The retaining wall as set forth in claim 6 wherein at least one of said rods is anchored in said support closer to one lateral side of said retainer wall than to the other side of said retaining wall.

8. The retaining wall as set fort in claim 7 wherein each of said rods being anchored in said support closer to one side of said retaining wall than to the other side of said retaining wall is bent above said support to locate the upper end of said rod in proximity to said plate essentially centered between the lateral sides of said retaining wall.

9. The retaining wall as set forth in claim 6 including additional rods anchored in said support and extending upwardly through said retaining wall, through one or more of said plates and into said extended wall, at least one yet further apertured plate disposed in said extended wall for penetrably receiving the upper end of at least one of said additional rods, each of said upper ends of said additional rods being threaded to threadedly receive a nut to draw said additional rod toward said yet further apertured plate and place said additional rod in tension.

10. The retaining wall as set forth in claim 6 wherein said one end includes a threaded section and a nut threadedly engaging said threaded section.

11. A retaining wall for retaining soil on one side thereof, said retaining wall comprising in combination:

a) a support for said retaining wall;

b) a plurality of courses of blocks having open cells extending vertically therethrough;

c) a plurality of rods having one end anchored in said support and extending upwardly through the cells in the blocks of said courses;

d) at least one apertured plate disposed along the top of one of said plurality of courses for penetrably receiving one r more of said threaded ends of said rods;

e) at least one of said rods being anchored in said support to one lateral side of said retainer wall than to the other side of said retaining wall, each of said rods being anchored in said support closer to one side of said remaining wall than to the other side of said retaining wall being bent to locate the upper end of aid rod in proximity to said plate essentially centered between the lateral sides of said retaining wall;

f) a plurality of nuts for threadedly engaging said threaded ends of said rods to draw said rods toward said plate and lace said rods in tension; and g) a bond beam supported by said plate for encapsulating said threaded ends of said rod and said nuts;

h) a threaded coupling threadedly attached to each of said threaded ends of said rods;

i) a plurality of further rods, each of said further rods having upper and lower threaded ends, said lower threaded end of each of said further rods being threadedly engaged with one of said couplings;

j) a plurality of further courses laid on said bond beam to penetrably receive said further rods and defining an extended wall;

k) at least one apertured further plate resting upon one of said further courses for receiving at least one of said upper ends of said further rods; and l) a plurality of further nuts, each of said further nuts being in threaded engagement with one of said upper ends of said further rods to draw said further rod toward said at least one plate and place said further rod in tension within said extended wall.

12. A retaining wall for retaining soil on one side thereof said retaining wall comprising in combination:

a) a support for said remaining wall;

b) a plurality of course of blocks having open cells extending vertically therethrough;

c) a plurality of rods having one end anchored in said support and extending upwardly through the cells in the blocks of said courses, at least one of said rods being anchored in said support closer to one lateral side of said retainer wall than to the other said of said retaining wall, each of said rods being anchored in said support closer to one side of said retaining wall than to the other side of said retaining wall being bent to locate the upper end of said rod in proximity to said plate essentially centered between the lateral sides of said retaining wall;

d) at least one apertured plate disposed along the top of one of said plurality of courses for penetrably receiving one or more of said threaded ends of said rods;

e) a plurality of nuts or threadedly engaging said threaded ends of said rods to draw said rods toward said plate and place said rods in tension;

f) a bond beam supported by said plate for encapsulating said threaded ends of said rod and said nuts;

g) a threaded coupling threadedly attached to each of said threaded ends of said rods;

h) a plurality of further rods, each of said further rods having upper and lower threaded ends, said lower threaded e d of each of said further rods being threadedly engaged with one of said couplings;

i) a plurality of further courses laid on said bond beam to penetrably receive said further rods and defining an extended wall;

j) at least one aperture further plate resting upon one of said further courses for receiving at least one of said upper ends of said further rods; and k) a plurality of further nuts, each of said further nuts being in threaded engagement with one of said upper ends of said further rods to draw said further rod toward said at least one plate and place said further rod in tension within said extended wall.

13. A method for constructing retaining wall to hold a body of soil having an upper grade level at its surface at its upper end and a lower grade level beneath the surface, said method comprising the steps of:

a) forming a support at or below the lower grade level;

b) positioning each of a plurality of post-tensioning rods vertically at predetermined horizontal intervals extending into the support when the latter is in plastic form;

c) forming a plurality of courses of masonry blocks with the open cells in each block penetrably receiving the respective vertically extending post-tensioning rods;

d) placing at least one apertured clamping plate on top of the last course of block of open cells to penetrably receive one or more of the vertically extending post-tensioning rods;

e) placing each of a plurality of nuts on a different threaded end of a post tensioning rod and tightening the nuts to draw the post-tensioning rods toward the plate and to provide a predetermined tension in each post-tensioning rod; and f) forming a bond beam with at least one rod extending longitudinally therethrough to encapsulate the ends of the post-tensioning rods and the nuts.

14. The method as set forth in claim 13 further comprising the step of constructing an extended wall on the bond beam.

15. The method as set forth in claim 13 wherein said step of forming includes the forming of a conventional footer.

16. The method as set forth in claim 13 wherein said step of forming includes the step of forming a conventional foundation.

17. The method as set forth in claim 13 wherein said step of forming includes the step of forming a conventional retaining wall.

18. The method as set forth in claim 13 including the step of threadedly engaging a nut with the end of the rod extending into the support.

19. A method for constructing a taming wall to hold a body of soil having an upper grade level at its surface at its upper end an a lower grade level beneath the surface, said method comprising the steps of:

a) forming a support at or below the lower grade level;

b) positioning each of a plurality of post-tensioning rods vertically at predetermined horizontal intervals extending into the support when the latter is in plastic form;

c) forming a plurality of courses of masonry blocks with the open cells in each block penetrably receiving the respective vertically extending post-tensioning rods;

d) placing at least one apertured clamping plate on top of the last course of block of open cells to penetrably receive the vertically extending post-tensioning rods;

e) placing each of a plurality of nuts on a different threaded end of a post-tensioning rod and tightening the nuts to draw the post-tensioning rods toward the plate and to provide a predetermined tension in each post-tensioning rod;

f) forming a bond be on top of the plate to encapsulate the ends of the post-tensioning rods and the nuts;

g) constructing an extended wall on the bond beam;

h) adding a threaded coupling to each threaded end of the post-tensioning rods above the nuts;

i) threadedly engaging an upwardly extending further rod to each coupling for penetrable engagement with the blocks of the extended wall;

j) said step of adding and said step of threadedly engaging being carried out prior to completion of said step of forming the bond beam;

k) penetrably engaging the upper threaded end of the further rods with at least one plate resting upon a course of the extended wall; and l) drawing each of the further rods toward the at least one plate by tightening a nut in threaded engagement with each upper end of the further rods to place the further rods in tension.

* * * * *